US010633142B2

(12) United States Patent
Lilja

(10) Patent No.: US 10,633,142 B2
(45) Date of Patent: Apr. 28, 2020

(54) MULTI-CASE

(71) Applicant: Menasha Corporation, Neenah, WI (US)

(72) Inventor: Chad Michael Lilja, Farmington, MN (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 15/842,021

(22) Filed: Dec. 14, 2017

(65) Prior Publication Data

US 2018/0170612 A1 Jun. 21, 2018

Related U.S. Application Data

(60) Provisional application No. 62/434,861, filed on Dec. 15, 2016.

(51) Int. Cl.

| | |
|---|---|
| ***B65D 5/50*** | (2006.01) |
| ***B65D 5/54*** | (2006.01) |
| ***B65D 5/48*** | (2006.01) |

(52) U.S. Cl.

CPC ..... *B65D 5/5445* (2013.01); *B65D 5/48014* (2013.01)

(58) Field of Classification Search

CPC ..... B65D 5/5445; B65D 5/48014; B65D 2571/00141; B65D 2571/0066; B65D 2571/00728; B65D 2571/5405

See application file for complete search history.

(56) References Cited

U.S. PATENT DOCUMENTS

| | | | | |
|---|---|---|---|---|
| 4,899,929 | A | 2/1990 | Grollman | |
| 5,048,690 | A * | 9/1991 | Zimmerman | B65D 5/48014 206/746 |
| 5,167,324 | A * | 12/1992 | Miller | B65D 5/48014 206/738 |
| 5,722,584 | A * | 3/1998 | Fujiwara | B65D 5/48014 229/120.15 |
| 5,826,728 | A | 10/1998 | Sheffer | |
| 6,676,012 | B1 | 1/2004 | Southwell et al. | |
| 6,729,475 | B2 * | 5/2004 | Yuhas | B65D 5/52 206/746 |
| 8,827,078 | B2 | 9/2014 | Doemel et al. | |
| 9,090,037 | B2 | 7/2015 | Swenson | |
| 9,181,025 | B2 | 11/2015 | Graham et al. | |
| 9,242,758 | B2 | 1/2016 | Brundage et al. | |
| 9,382,041 | B2 | 7/2016 | Couture | |
| 9,440,763 | B1 | 9/2016 | Einstein | |
| D783,395 | S | 4/2017 | Wang | |
| 9,783,334 | B2 | 10/2017 | McLeod et al. | |
| 9,919,829 | B2 | 3/2018 | Jolley | |
| 9,938,040 | B2 | 4/2018 | Buscema | |
| 9,994,356 | B2 | 6/2018 | Couture | |

(Continued)

*Primary Examiner* — Corey N Skurdal

(74) *Attorney, Agent, or Firm* — Greensfelder, Hemker & Gale, P.C.

(57) ABSTRACT

The present invention provides a multi-cased box that can be used to transport and then display the goods being transported. The box can be formed from a single blank of material that is folded and glued into a box shape. The box includes a frangible line that—when broken—allows for removal of a portion of the box. The box also includes divider panels that form two or more compartments in the interior of the box.

20 Claims, 10 Drawing Sheets

(56) References Cited

U.S. PATENT DOCUMENTS

| | | | | |
|---|---|---|---|---|
| 10,144,549 | B2 | 12/2018 | Manella | |
| D842,695 | S | 3/2019 | Haen et al. | |
| D842,696 | S | 3/2019 | Haen et al. | |
| 10,232,999 | B2 | 3/2019 | Lingamfelter | |
| D846,384 | S | 4/2019 | Borkovetz et al. | |
| D846,385 | S | 4/2019 | Borkovetz et al. | |
| D846,386 | S | 4/2019 | Borkovetz et al. | |
| 10,273,043 | B2 | 4/2019 | Couture | |
| 2006/0006096 | A1* | 1/2006 | Funk | B65D 5/0227 206/746 |
| 2012/0234724 | A1* | 9/2012 | James | B65D 5/5445 206/774 |
| 2013/0020230 | A1 | 1/2013 | Doemel et al. | |
| 2015/0041364 | A1 | 2/2015 | Schultz et al. | |
| 2015/0191272 | A1 | 7/2015 | McLeod et al. | |
| 2016/0304237 | A1 | 10/2016 | Couture | |
| 2017/0267398 | A1 | 9/2017 | Couture | |
| 2017/0267399 | A1 | 9/2017 | Buscema | |
| 2017/0275046 | A1 | 9/2017 | Manella | |
| 2017/0305593 | A1 | 10/2017 | Couture | |
| 2018/0162575 | A1 | 6/2018 | Buscema et al. | |
| 2018/0222626 | A1 | 8/2018 | Pfeifer et al. | |
| 2019/0016501 | A1 | 1/2019 | Djokovic et al. | |
| 2019/0023449 | A1 | 1/2019 | Barton et al. | |
| 2019/0135482 | A1 | 5/2019 | Pratsch et al. | |

* cited by examiner

MULTI-CASE

CROSS-REFERENCE TO RELATED APPLICATIONS

The present invention claims the benefit of U.S. Provisional Patent Application No. 62/434,861 filed Dec. 15, 2016, the contents of which are incorporated herein by reference.

FEDERALLY SPONSORED RESEARCH OR DEVELOPMENT

N/A.

FIELD OF THE INVENTION

The present invention is directed to a container having interior divider panels that is formed from a blank of material having a frangible portion to allow for removing a portion of the container after shipping for displaying goods in the container.

DESCRIPTION OF THE PRIOR ART

Removing products from a transport container, such as a box, and placing them on a display for sale (e.g., a shelf or other display device) can be time consuming and costly. The present invention provides a package for transporting goods that can be quickly turned into a display without requiring removal and replacement of the goods contained therein.

SUMMARY OF THE INVENTION

The present invention provides a container formed from a blank of material such as a corrugated paper, or paperboard. Other similar materials, including a corrugated plastic, may also be used.

The container is formed into a rectangular box with an inner dividing wall separating the interior into two spaces. A first portion of the container (e.g., such as an upper portion—when the container is formed into the container shape) is connected to a second portion (e.g., lower portion) of the container by a frangible connection. After transporting the container, the frangible connection can be broken and the first portion of the container can be removed to expose goods in the container. In this manner, the second portion of the container can act as a display for the goods.

In accordance with one aspect of the invention, a container for shipping and displaying goods is provided. The container comprises a first end panel, a second end panel, a first side wall panel and a second side wall panel, a plurality of flaps connected to the first and second end panels and first and second side wall panels for forming a top wall and a bottom wall. The container further includes a frangible line (i.e., a breakable connection, such as a perforated line in the material) through the first and second side wall panels and the first end wall panel separating the container to a top portion and a bottom portion. The frangible line is configured to break to allow for separation of the top portion from the bottom portion.

The container further includes a first divider panel separating an interior of the container into a first portion and a second portion. The frangible line can also extend through the first divider panel. The first divider panel can be connected to an end portion that is glued to an interior surface of the first end panel of the container. The container can also include a second divider panel in the interior of the container.

The container can be formed from a corrugated paper material or other similar materials. The container can be formed from a single blank of such material. The first end of the single blank of material can be used to form the first divider panel of the container.

The frangible line can extend continuously from a first end of the single blank of material to an opposing second end of the single blank of material.

In accordance with another aspect of the invention, a foldable box for shipping and displaying goods is provided. The box comprises a first side wall panel, a first end panel, a second side wall panel and a second end panel. The box further includes a first divider panel in an interior of the box where the first divider panel forming a first chamber and a second chamber in the interior. The box further includes a bottom wall and a top wall, and a breakable connection dividing the box into a first portion and a second portion.

The first divider panel can include an end portion glued to an interior surface of the first end wall. In addition to the first divider panel, the box can further comprise a second divider panel in the interior of the box. The second divider panel can also include an end portion glued to the interior surface of the first end panel.

The second end panel can be formed from a first panel segment and a second panel segment. The first panel segment can be connected to the first divider panel and the second panel segment can be connected to the second divider panel. The first divider panel and the second divider panel can be glued to each other.

The bottom wall of the box can be formed from flaps extending downward from the first side wall, first end wall, second side wall and second end wall. Similarly, the top wall of the box can be formed from flaps extending upward from the first side wall, first end wall, second side wall and second end wall.

The breakable connection can include a first finger opening (as well as a second finger opening) to facilitate breaking the breakable connection. The first finger opening can be a semi-circular portion of the breakable connection that is initially pushed inward to create the opening.

Each of the first side wall, first end wall, second side wall, second end wall, bottom wall and top wall can be formed from a corrugated paper or other similar material. Each of the first side wall, first end wall, second side wall, second end wall, bottom wall and top wall can be formed from a single blank of material (alternatively, multiple pieces of material glued or otherwise fastened together could be used). The breakable connection can extend from a first end of the single blank of material to a second opposing end of the single blank of material.

Other aspects of the invention are shown in the Figures and are further described herein.

BRIEF DESCRIPTION OF THE DRAWINGS

To understand the present invention, it will now be described by way of example, with reference to the accompanying drawings in which.

DETAILED DESCRIPTION

Figure 1:
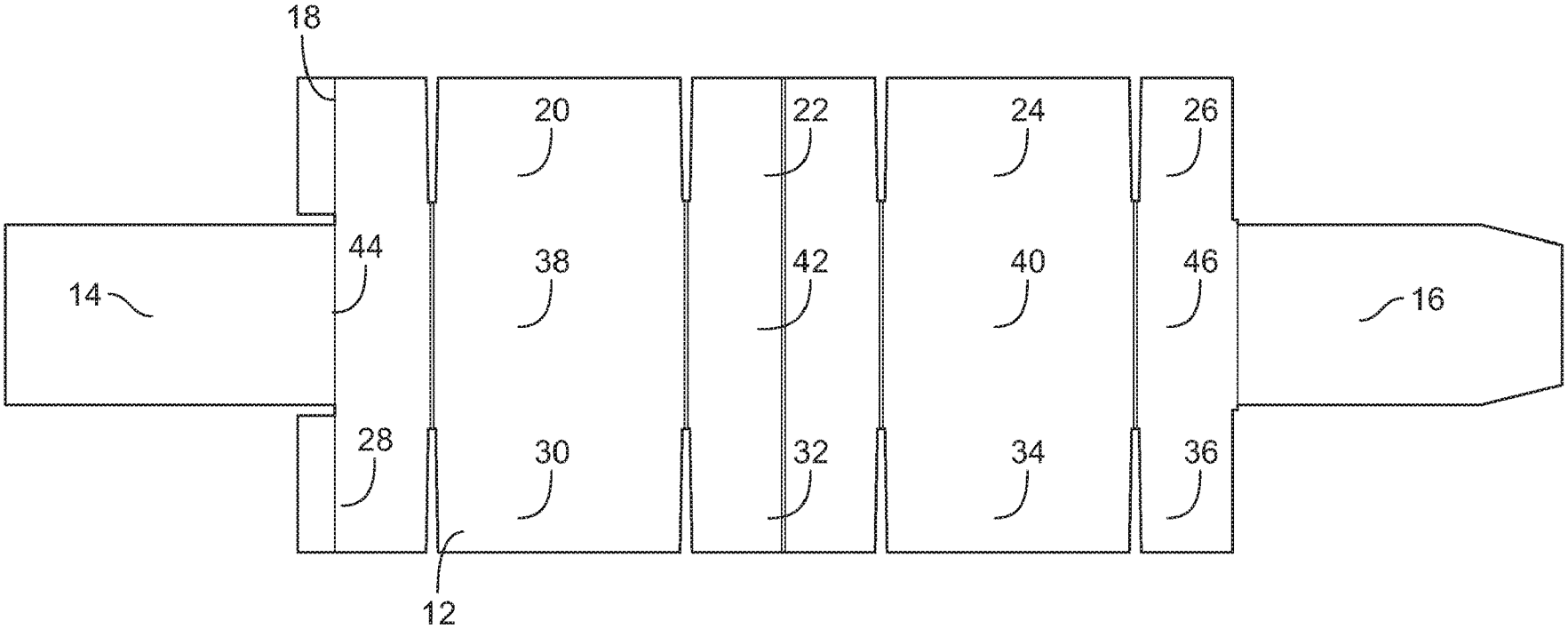
FIG. 1 is a plan view of a blank for forming a box in accordance with the present invention.
Figure 2A:
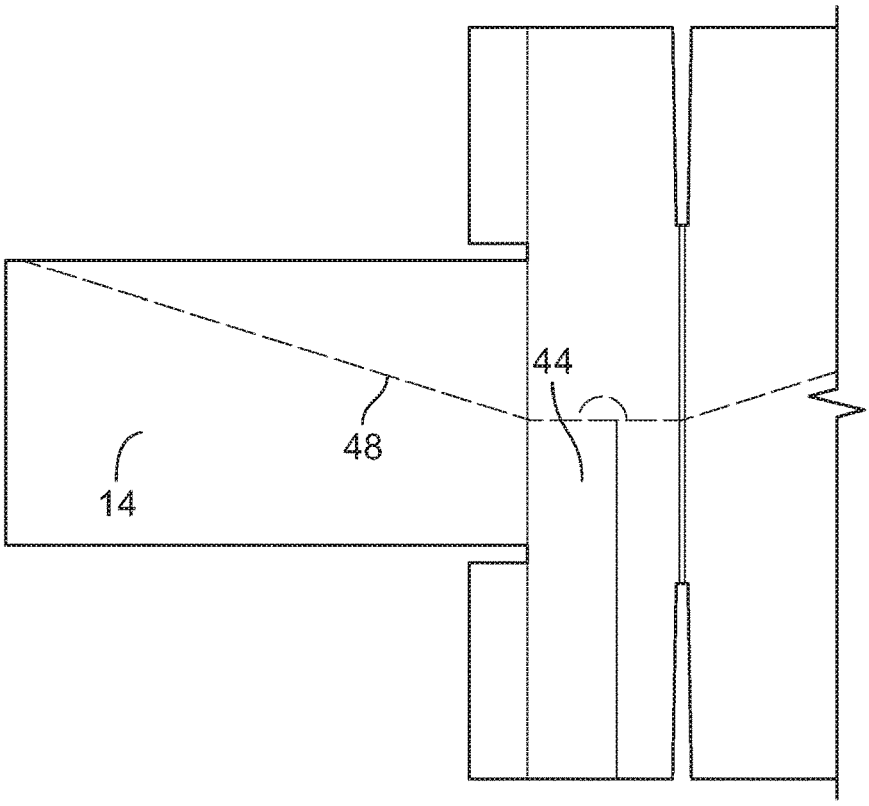
FIGS. 2*a*-2*d* are plan views of portions of the blank of FIG. 1 showing a frangible line extending from one end of the blank to the other end of the blank.
Figure 2B:
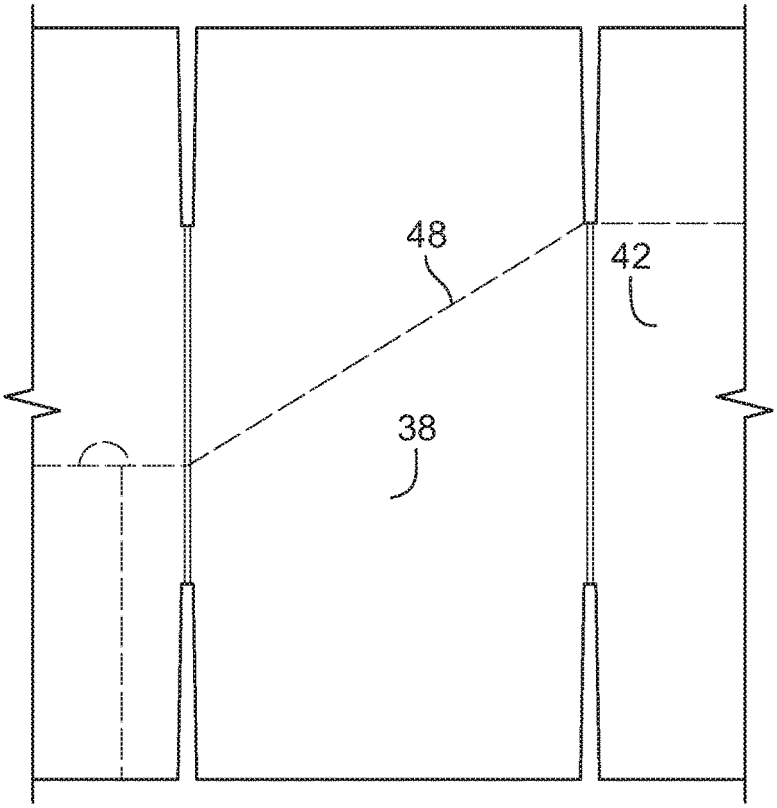
Figure 2C:
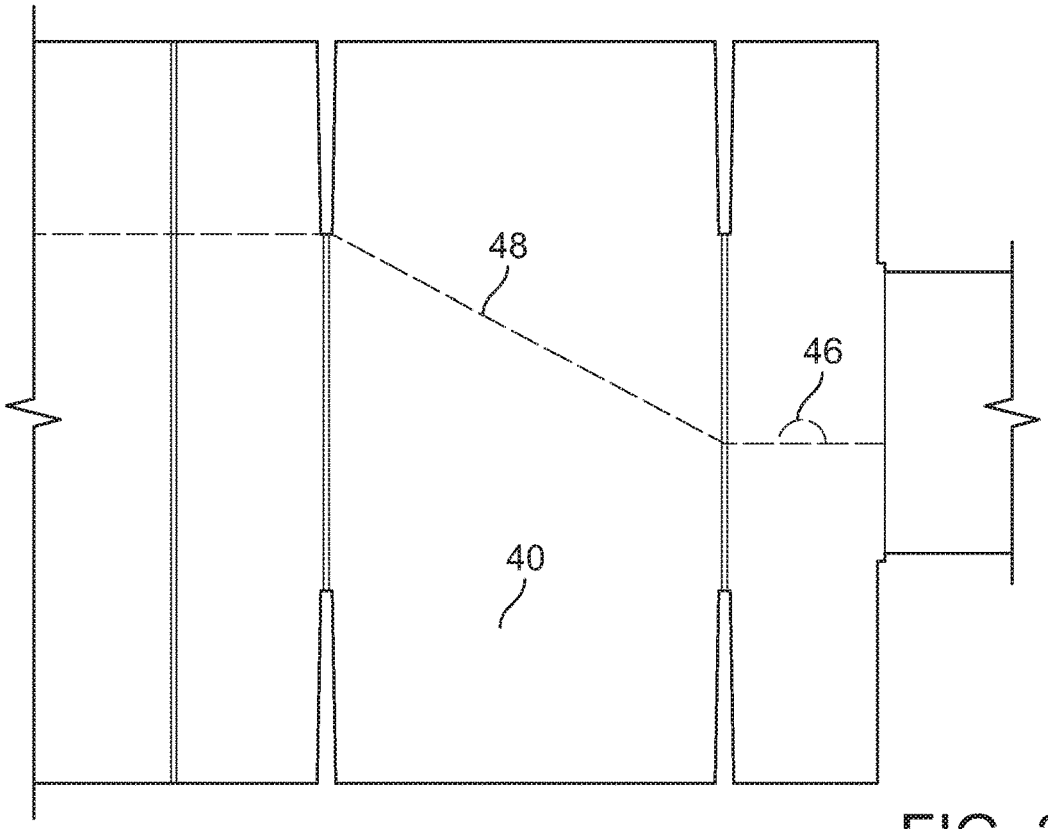
Figure 2D:
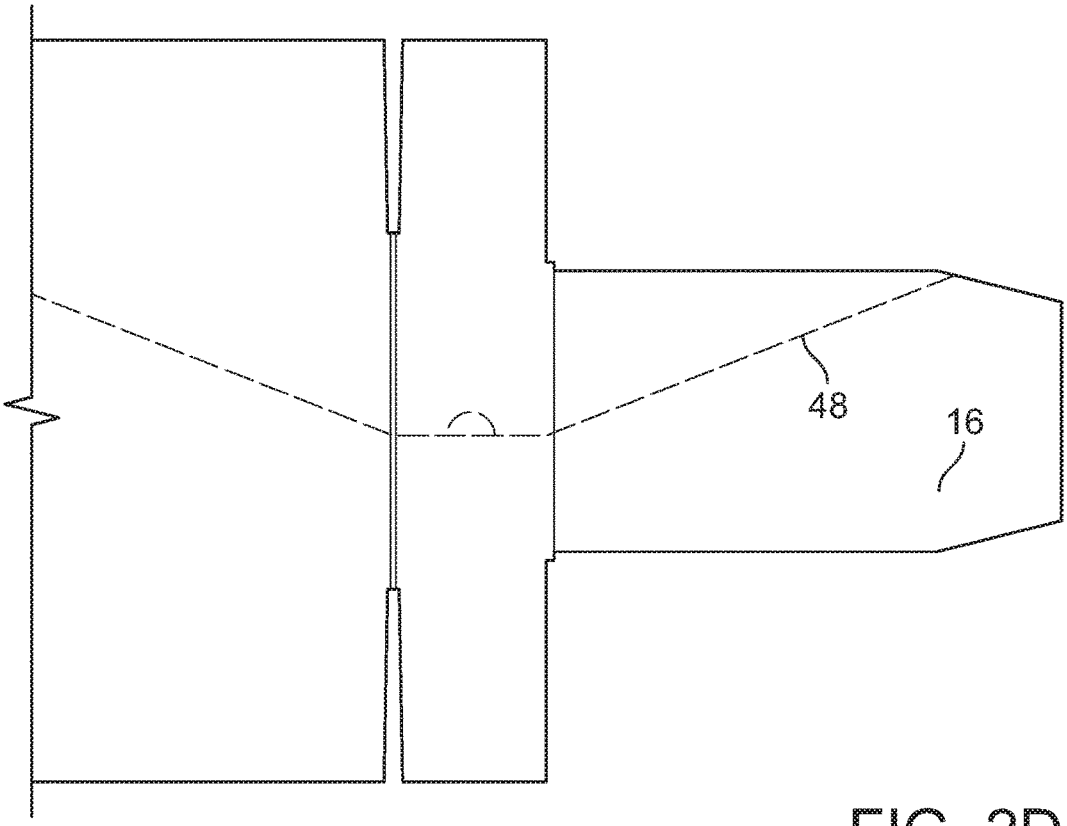

While this invention is susceptible of embodiments in many different forms, there is shown in the drawings and Appendixes, and will herein be described in detail preferred embodiments of the invention with the understanding that the present disclosure is to be considered as an exemplification of the principles of the invention and is not intended to limit the broad aspect of the invention to the embodiments illustrated.

The present invention is directed toward container or box 10 with multiple compartments that can be used to ship goods and then be converted into a display of the goods. The box 10 can be formed from a single blank of material 12, such as paperboard, corrugated paper, corrugated plastic or other similar or suitable materials. The blank 12 (and resulting box 10) includes a frangible line (i.e., a breakable connection between a first portion of the blank 12 and a second portion of the blank 12) that—when broken—enables removal of a portion of the box 10 to expose and display the goods contained in the remainder of the box 10.

The blank includes two interior divider panels (two outermost panels from both sides of the blank) that are each connected to half of a first end panel. Each half end panel is connected to one of the first and second side wall panels. The first and second side wall panels are, in turn, connected to opposite sides of a second end panel for the container. Flaps for forming a top and bottom panel extend from each of the end and side wall panels.

The blank folds into a generally rectangular shaped box or container. The interior panels form a centrally located wall from the first end to the second end in the interior of the rectangular shape (while two panels glued together are shown in the photographs, the interior panel can be a single panel).

Specifically referring to FIGS. 1, 2*a-d* and 12, the blank 12 is shown having a plurality of panels for forming the box 10. The blank 12 includes a first compart divider panel 14 at one end and a second compartment divider panel 16 at an opposing end. The blank 12 includes a plurality of panels or flaps 18, 20, 22, 24 and 26 for forming a top wall of the box 10, and a plurality of panels or flaps 28, 30, 32, 34 and 36 for forming a bottom wall of the box 10. The blank 12 includes two side wall panels 38, 40 and a first end wall panel 42. Two half panels 44, 46 form a second end wall of the box 10.

Figure 12:
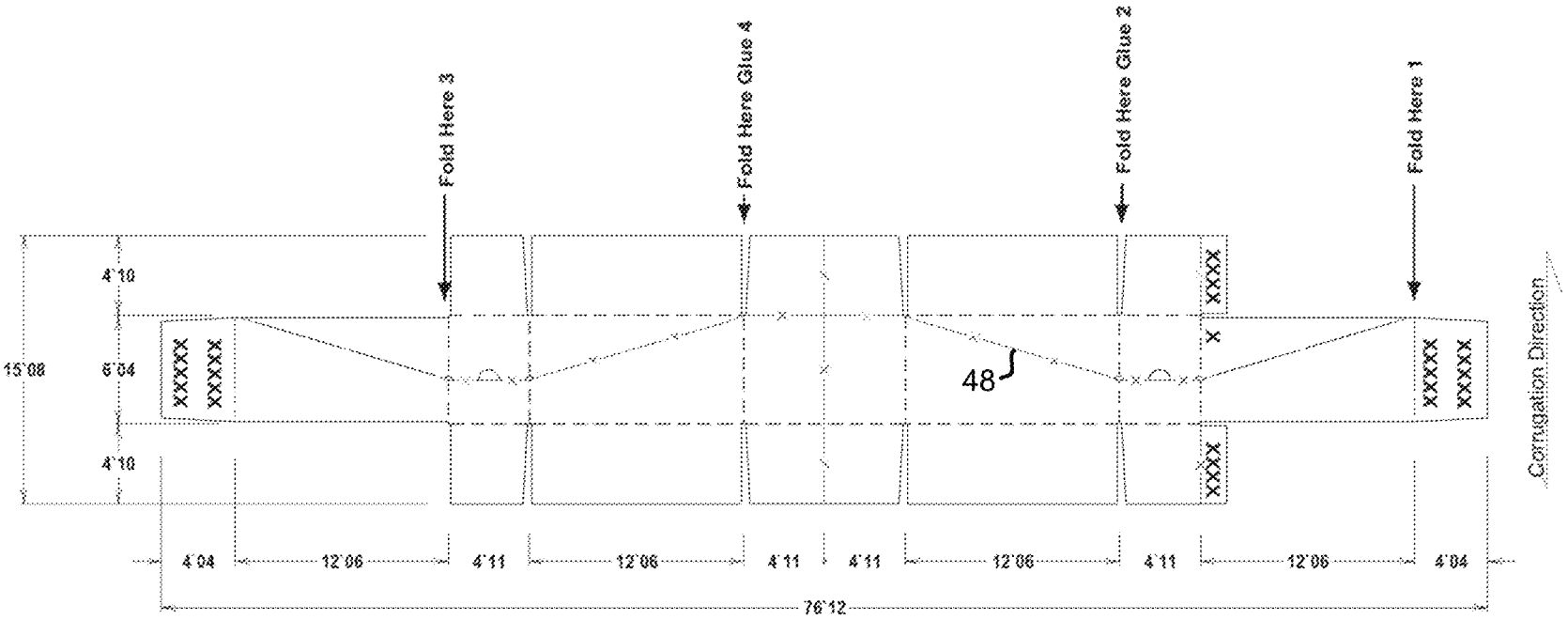

As illustrated in FIGS. 2*a-d* and 12, the blank 12 includes a frangible line 48 that extends from one end of the blank 12 to the other end of the blank 12. As illustrated in FIG. 12, glue spots are marked with "x"'s and fold lines are marked with dashed lines. The frangible line 48 is shown in FIG. 12 having a somewhat sawtooth pattern as a solid line interspersed with "x"'s. The frangible line splits the rectangular shape of the container into a top portion and a bottom portion. The side walls of the bottom portion have a top edge that slants from a front end of the box upward toward a back end of the box. Other configurations/shapes of the box portions can also be implemented. Graphics, advertising and other printing can be used with the box as well.

Figure 3:
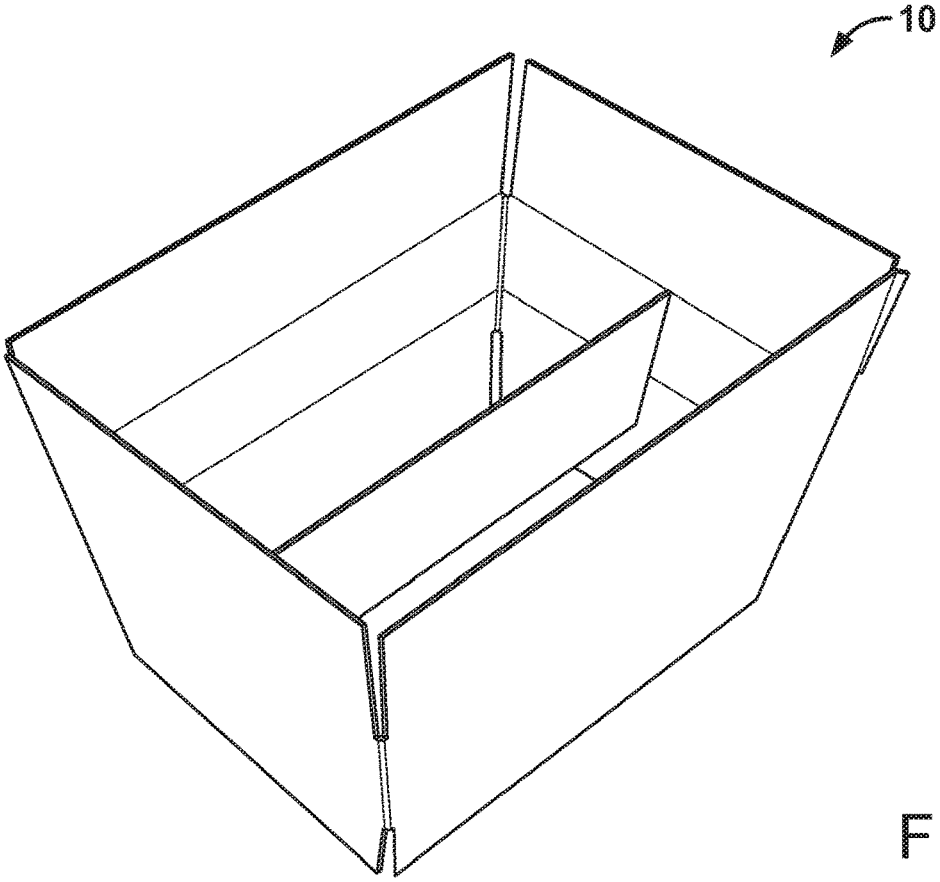
FIG. 3 is a perspective view of a partially erected box formed from the blank of FIG. 1 showing a divider panel in the interior of the box.
Figure 4:
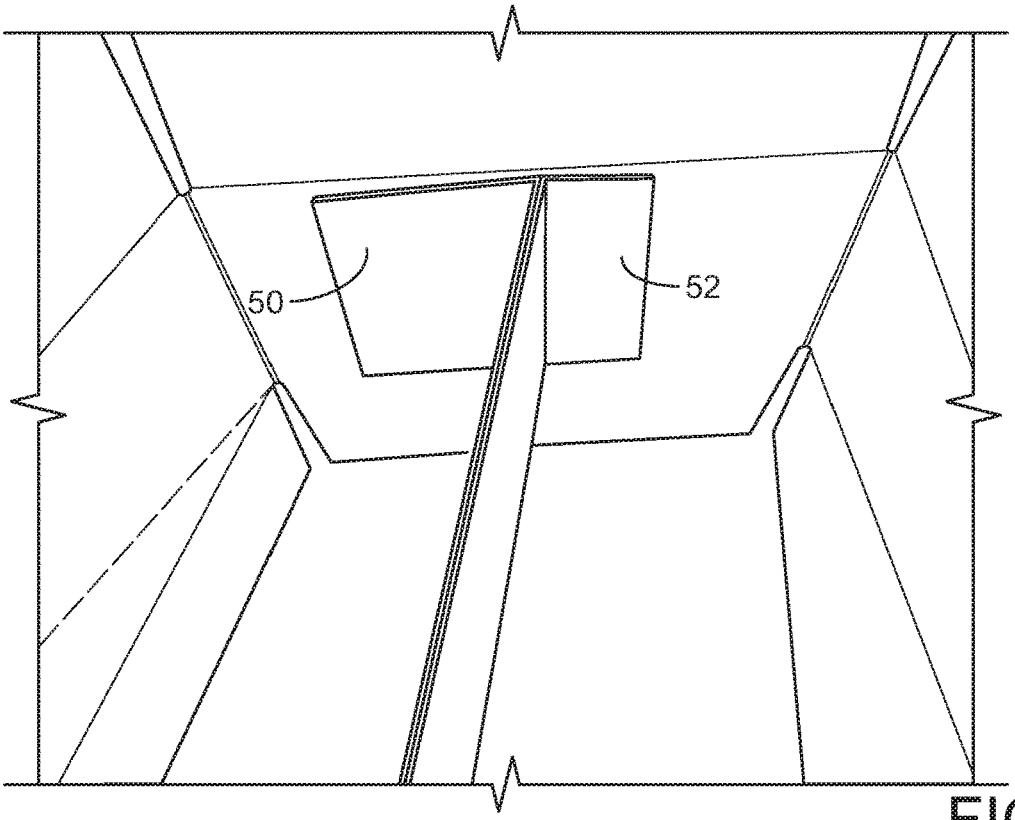
FIG. 4 is a perspective close up view of a portion of the interior of the partially erected box of FIG. 4.

FIGS. 3 and 4 show the box 10 partially set up (with the flaps forming the top and bottom of the box unfolded). The divider panels 14, 16 are positioned next to each other and together form a divider or partition separating the interior of the box 10 into two sections. FIG. 4 shows the ends 50, 52 of the divider panels 14, 16, bent at a 90° angle and glued to the interior of the end wall 42. The remainder of each divider panel 14, 16 can be glued to each other.

Figure 5:
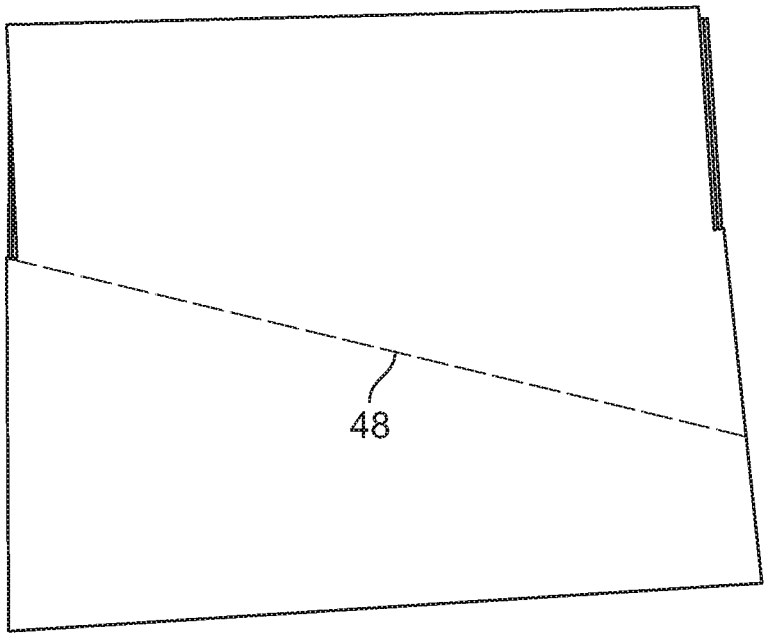
FIG. 5 is a plan view of a side of the box of FIG. 4.

FIG. 5 shows a side of the partially set up box 10 with the bottom flaps folded to form a bottom wall of the box 10. A portion of the frangible line 48 is evident extending across the side wall 38.

Figure 6:
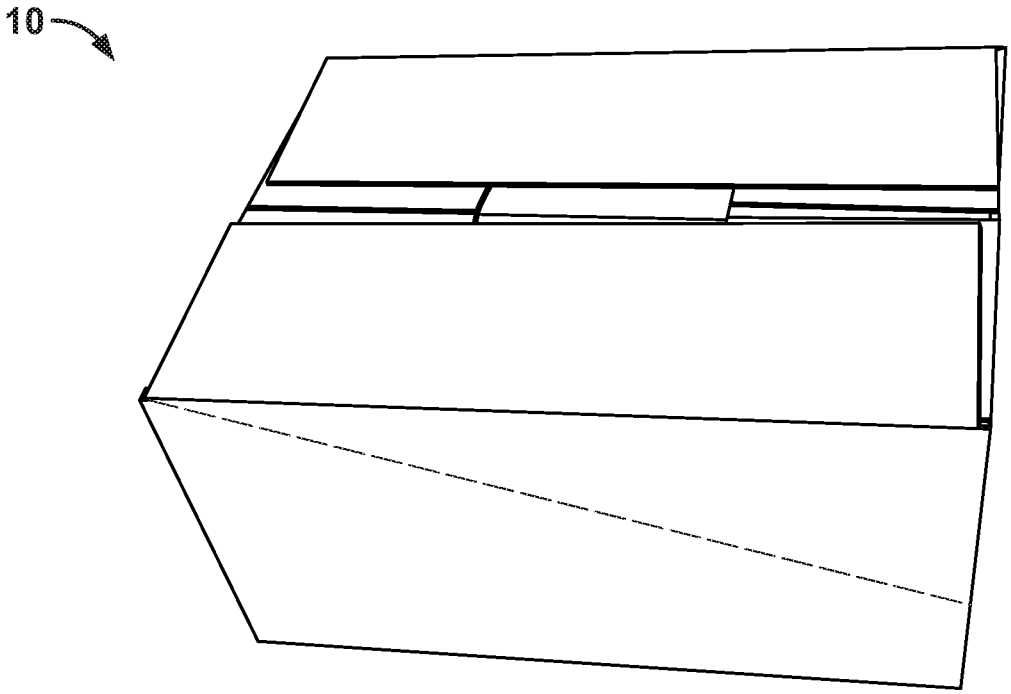
FIG. 6 is a perspective view of completely erected box of the blank of FIG. 1.

FIG. 6 show the box 10 in a fully set up configuration for transporting goods. The box 10 has a typical rectangular box shape.

Figure 7:
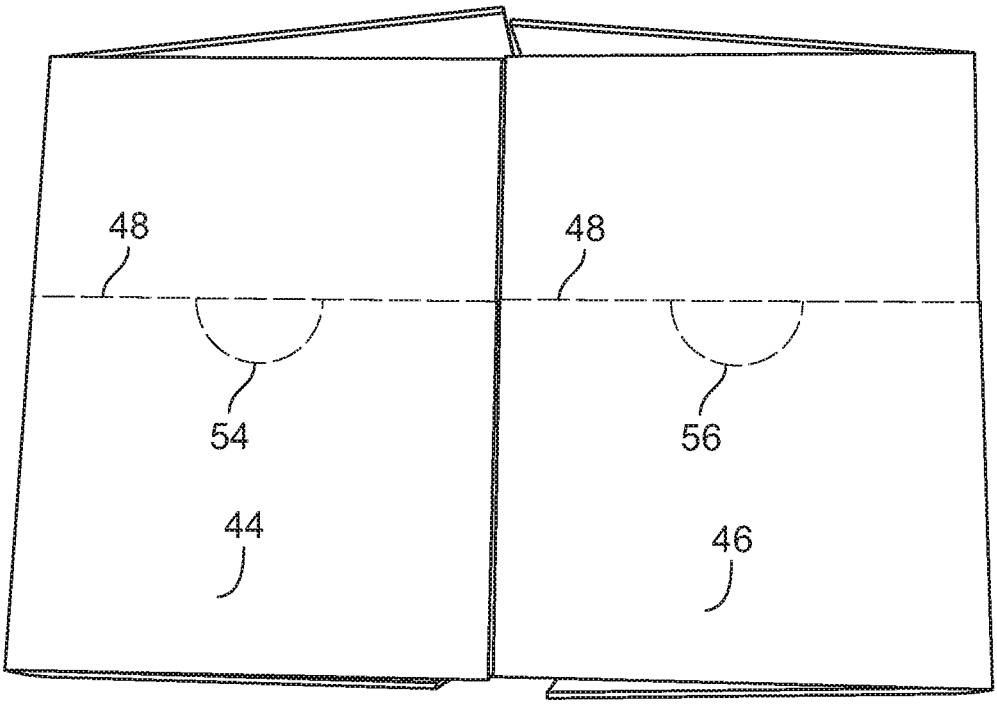
FIG. 7 is a plan view of an end of the box of FIG. 6.

FIG. 7 shows a view of an end of the box 10 formed from half end panels 44 and 46. A part of the frangible line 48 is shown going across both of the half end panels 44, 46. Additionally, each of the two half end panels 44, 46 are provided with frangible half or semi-circular portions 54, 56. The half circular portions 54, 56 can be easily broken and pushed-in to create finger holes or openings to facilitate separating the top portion of the container from the bottom portion along the frangible line 48 (e.g., by breaking the frangible line).

Figure 8:
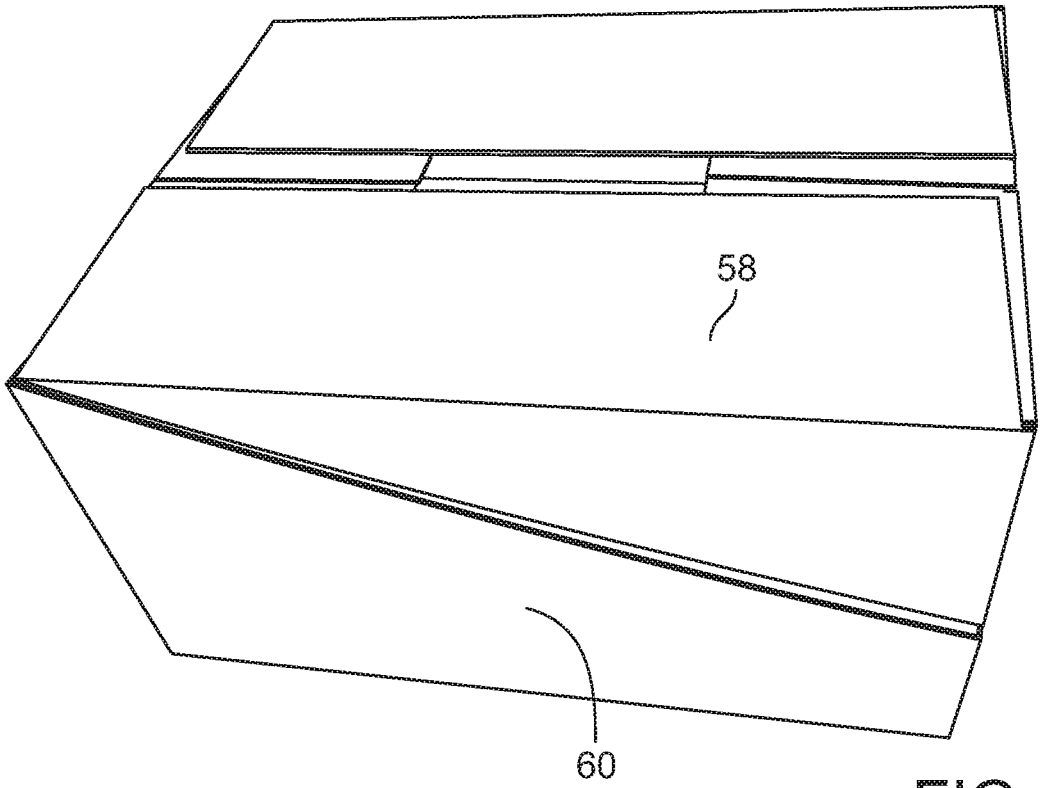
FIG. 8 is a perspective view of the completely erected box of FIG. 6 with the frangible line broken.
Figure 9:
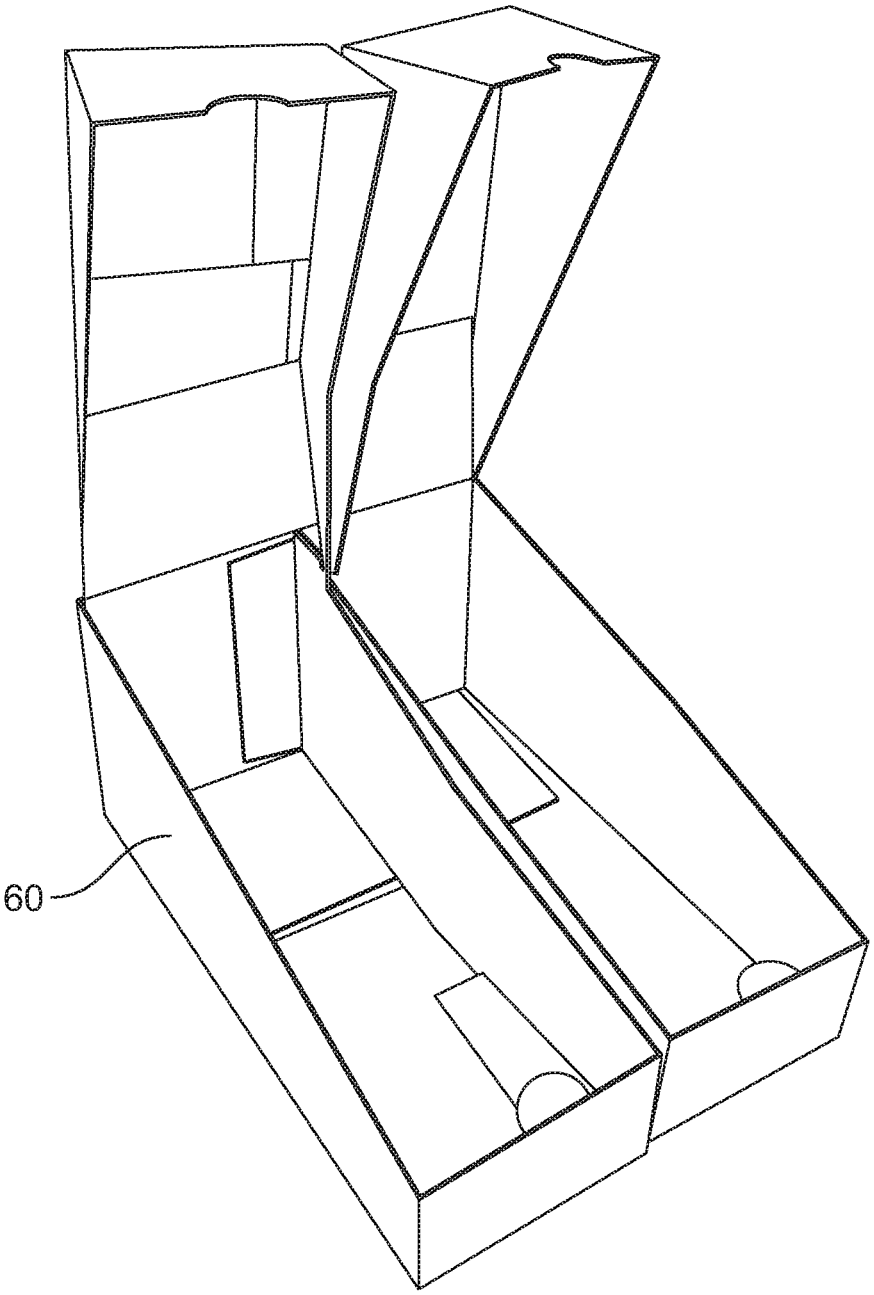
FIG. 9 is a perspective view of the box of FIG. 8 with a top portion rotated upward.
Figure 10:
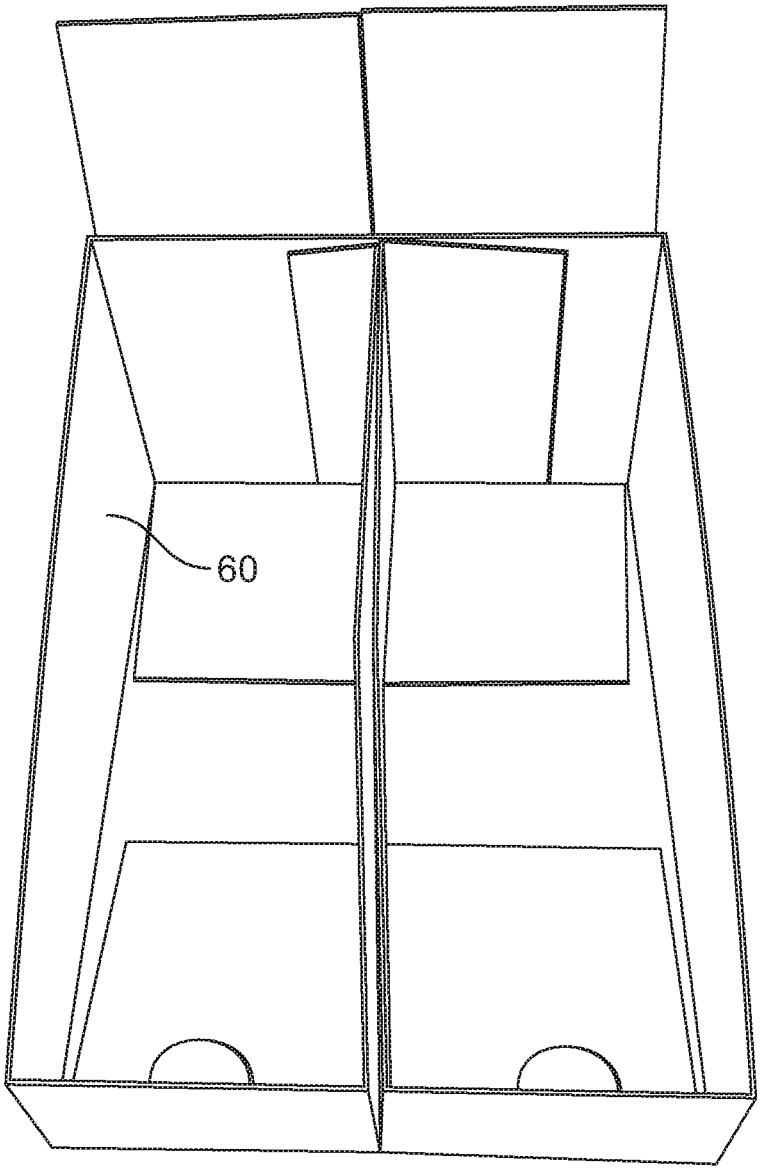
FIG. 10 is a perspective view of the lower portion of the box of FIG. 8 with the top portion removed.
Figure 11:
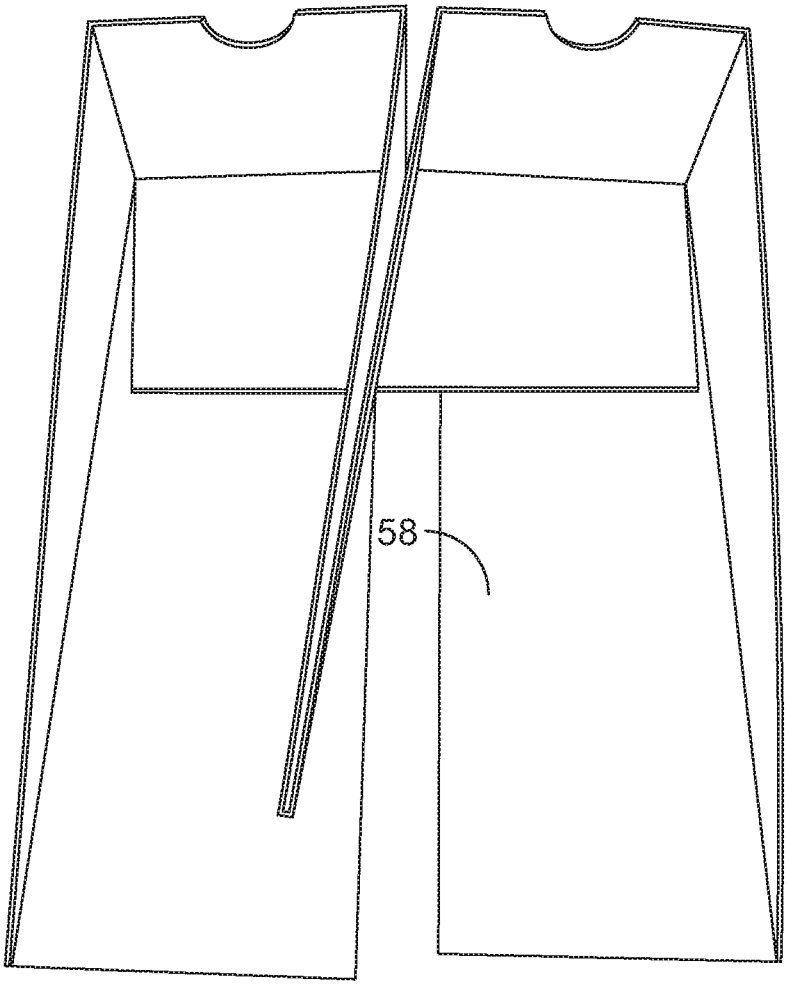
FIG. 11 is a perspective view of the top portion of the box of FIG. 8; and, FIG. 12 is another plan view of the blank for forming the present box.

As discussed herein, the box 10 can be converted to a display after transportation to a store. This is accomplished by breaking the frangible line 48 (as initially shown in FIG. 8) which separates the box 10 into a top portion 58 and a bottom portion 60. The top portion 58 can be removed completely as shown in FIG. 10, or rotated upward to act as a back of the display as shown in FIG. 9. Once the top portion 58 is removed or rotated, the bottom portion 60 of the box 10 is shown having two compartments separated by the divider panels 14, 16 (while two compartments are shown, the divider panels can have different configurations for creating additional compartments, such as being bent 90° at a midway point whereby the end is connected to a side wall and not the opposing end wall). Goods placed in the box 10 can be displayed with the top portion 58 removed or rotated.

Many modifications and variations of the present invention are possible in light of the above teachings. It is, therefore, to be understood within the scope of the appended claims the invention may be protected otherwise than as specifically described.

I claim:

1. A container comprising:

a first end panel, a second end panel, a first side wall panel and a second side wall panel, a plurality of flaps connected to the first and second end panels and first and second side wall panels for forming a top wall and a bottom wall;

a frangible line through the first and second side wall panels and the first end wall panel separating the container to a top portion and a bottom portion, the frangible line configured to break to allow for separation of the top portion from the bottom portion, wherein the bottom portion includes the bottom wall, a first end panel portion, a second end panel portion, a first side wall panel portion, and a second side wall panel portion in which the first end panel portion has a height from the bottom wall to an upper edge of the first end panel portion greater than a height of the second end panel portion from the bottom wall to an upper edge of the second end panel portion, the frangible line configured to provide a first opening proximate the upper edge of the second end panel portion to facilitate separation of the top portion from the bottom portion.

2. The container of claim 1 further comprising a first divider panel separating an interior of the container into a first portion and a second portion.

3. The container of claim 2 wherein the frangible line extends through the first divider panel.

4. The container of claim 3 wherein the container is formed from a single blank of material.

5. The container of claim 4 wherein the frangible line extends from a first end of the single blank of material to an opposing second end of the single blank of material.

6. The container of claim 5 wherein the first end of the single blank of material forms the first divider panel of the container.

7. The container of claim 2 wherein the first divider panel is connected to an end portion that is glued to an interior surface of the first end panel.

8. The container of claim 2 further comprising a second divider panel in the interior of the container.

9. The container of claim 1 wherein the container is formed from a corrugated paper material.

10. A box for shipping and displaying goods comprising:

a first side wall panel, a first end panel, a second side wall panel and a second end panel;

a first divider panel in an interior of the box, the first divider panel forming a first chamber and a second chamber in the interior;

a bottom wall and a top wall; and, a breakable connection dividing the box into a first portion and a second portion, wherein the second portion includes the bottom wall, a first end panel portion, a second end panel portion, a first side wall panel portion, and a second side wall panel portion in which the first end panel portion has a height from the bottom wall to an upper edge of the first end panel portion greater than a height of the second end panel portion from the bottom wall to an upper edge of the second end panel portion, the breakable connection configured to provide a first opening proximate the upper edge of the second end wall panel portion to facilitate separation of the first portion from the second portion.

11. The box of claim 10 wherein the first divider panel includes an end portion glued to an interior surface of the first end panel.

12. The box of claim 11 wherein the box further comprises a second divider panel in the interior of the box wherein the second divider panel includes an end portion glued to the interior surface of the first end panel.

13. The box of claim 12 wherein the second end panel includes a first panel segment and a second panel segment.

14. The box of claim 12 wherein the first divider panel and the second divider panel are glued to each other.

15. The box of claim 10 wherein the bottom wall is formed from flaps extending downward from the first side wall, first end wall, second side wall and second end wall.

16. The box of claim 15 wherein the top wall is formed from flaps extending upward from the first side wall, first end wall, second side wall and second end wall.

17. The box of claim 10 wherein the breakable connection is configured to provide a second opening to facilitate breaking the breakable connection and separating the first portion from the second portion.

18. The box of claim 10 wherein each of the first side wall, first end wall, second side wall, second end wall, bottom wall and top wall are formed from a corrugated paper.

19. The box of claim 10 wherein the each of the first side wall, first end wall, second side wall, second end wall, bottom wall and top wall are formed from a single blank of material.

20. The box of claim 19 wherein the breakable connection extends from a first end of the single blank of material to a second opposing end of the single blank of material.

* * * * *